US011363867B2

(12) United States Patent
Tonelli

(10) Patent No.: US 11,363,867 B2
(45) Date of Patent: Jun. 21, 2022

(54) PORTABLE CONTAINER

(71) Applicant: G.T. LINE S.R.L., Valsamoggia (IT)

(72) Inventor: Massimo Tonelli, Bologna (IT)

(73) Assignee: G.T. LINE S.R.L, Valsamoggia (IT)

( * ) Notice: Subject to any disclaimer, the term of this patent is extended or adjusted under 35 U.S.C. 154(b) by 368 days.

(21) Appl. No.: 16/722,396

(22) Filed: Dec. 20, 2019

(65) Prior Publication Data

US 2020/0196725 A1 Jun. 25, 2020

(30) Foreign Application Priority Data

Dec. 21, 2018 (IT) ..... 102018000020665

(51) Int. Cl.

| | |
|---|---|
| ***A45C 13/26*** | (2006.01) |
| ***A45C 5/03*** | (2006.01) |
| ***A45C 5/14*** | (2006.01) |

(52) U.S. Cl.

CPC ..... *A45C 13/262* (2013.01); *A45C 5/03* (2013.01); *A45C 5/14* (2013.01); *A45C 2013/267* (2013.01)

(58) Field of Classification Search

CPC ..... A45C 13/262; A45C 5/03; A45C 5/14; A45C 2013/267

USPC ..... 190/18 A, 115, 108

See application file for complete search history.

(56) References Cited

U.S. PATENT DOCUMENTS

| | | | |
|---|---|---|---|
| 4,759,431 | A | 7/1988 | King et al. |
| 5,581,847 | A | 12/1996 | Hsieh |
| 5,615,757 | A | 4/1997 | Chen |
| 5,943,936 | A | 8/1999 | Decliman et al. |

OTHER PUBLICATIONS

IT Search Report dated Sep. 23, 2019 re: Application No. 102018000020665, pp. 1-7, citing: U.S. Pat. No. 5,943,936 A, U.S. Pat. No. 5,581,847 A, U.S. Pat. No. 4,759,431 A and U.S. Pat. No. 5,615,757 A.

*Primary Examiner* — John K Fristoe, Jr.
*Assistant Examiner* — Justin Caudill
(74) *Attorney, Agent, or Firm* — Cantor Colburn LLP

(57) ABSTRACT

A portable container, of the type of a trolley, suitcase, trunk, crate, and the like, includes at least one outer shell, for delimiting at least one accommodation compartment for objects in general, and an extractable handle, which can move between a minimum protrusion configuration, in which the handle is arranged in a respective seat, and at least one maximum protrusion configuration, in which the handle is extracted from the seat. The container includes at least one protrusion that protrudes from the edge of a slot and provided along the handle at least one respective recess provided on a tooth that contrast free movement of the handle.

7 Claims, 9 Drawing Sheets

PORTABLE CONTAINER

CROSS REFERENCE TO RELATED APPLICATIONS

This application is related to and claims the benefit of Italian Patent Application No. 102018000020665, filed on Dec. 21, 2018, the contents of which are hereby incorporated by reference in their entirety.

TECHNICAL FIELD

The present disclosure relates to a portable container.

BACKGROUND

The category of portable containers is certainly very broad and comprises products such as suitcases, rucksacks, trolleys, trunks, crates, and the like, which are mutual differentiated in terms of shape, dimensions, materials and/or functionality, as well as for their intended use, the type of goods that can be transported and/or the customers of reference.

In this field, a pair of wheels is often fitted on the shell of suitcases, trunks and trolleys in particular and allows practical transport thereof on the ground. To facilitate this use, on the opposite side with respect to the wheels the user can extract and grip a handle which is telescopic or otherwise extractable and is normally kept in a minimum protrusion configuration. In this latter configuration a locking system usually acts which prevents the extraction of the handle and can be deactivated only by the direct intervention of the user. The reason for the presence of this locking system can be deduced easily: first of all, when the handle is extracted it is more difficult to handle the container. Furthermore, sometimes the user wishes to use the grip end of the handle, kept in the minimum protrusion configuration by the locking system, to carry the container without using the wheels, keeping it raised from the ground.

In known manners, this functionality is obtained by providing a slot in the handle in which, in the minimum protrusion configuration, a tooth integrally engages a sort of lever that can be activated by elastic deformation: the deformation causes the disengagement of the tooth from the slot, thus deactivating the locking system and allowing the extraction of the handle.

However, these locking systems have a very unpleasant drawback, which is unacceptable in the current market that involves increasingly mindful and demanding customers.

In greater detail, when the user grips the container at the grip end and carries it raised off the ground, the weight of the objects inside the container can be such as to cause in any case a deformation of the walls of the container (and of the lever in particular) the extent of which is sufficient to produce the disengagement of the tooth from the slot. This obviously causes the sudden movement of the handle, which under the action of gravity is extracted completely, with unquestionably unwelcome consequences.

In order to attempt to reduce the risk cited above, manufacturers have so far tried to increase the rigidity of the lever, so that it is not deformed significantly due to the weight of the container and of the objects inside it.

However, this solution is not at all satisfactory, since the increase in rigidity turns out to hinder the voluntary deactivation of the locking system, since it imposes a greater effort, which is often unacceptable, on the user who wishes to deform the lever in order to extract the handle.

SUMMARY

The aim of the present disclosure is to solve the problems described above, providing a portable container capable of contrasting effectively the accidental extraction of a telescopic handle.

Within this aim, the disclosure provides a portable container that is capable of reducing or avoiding the danger of accidental extraction of the telescopic handle even when said container is heavily loaded.

The disclosure also provides a portable container in which the capacity to contrast effectively the accidental extraction of the handle is combined with practical methods for voluntary extraction.

The disclosure further provides a portable container that ensures high reliability in operation and the user safety.

The disclosure also proposes a portable container that adopts a technical and structural architecture that is alternative to those of portable containers of the known type.

The disclosure provides a portable container that can be obtained easily starting from commonly commercially available elements and materials.

The disclosure further provides a portable container that has low costs and is safe in application.

This aim and these and other advantages which will become better apparent hereinafter achieved by providing a portable container according to claim 1.

BRIEF DESCRIPTION OF THE DRAWINGS

Further characteristics and advantages of the disclosure will become better apparent from the description of a preferred but not exclusive embodiment of the portable container according to the disclosure, illustrated by way of nonlimiting example in the accompanying drawings, wherein.

DETAILED DESCRIPTION OF THE DRAWINGS

Figure 1:
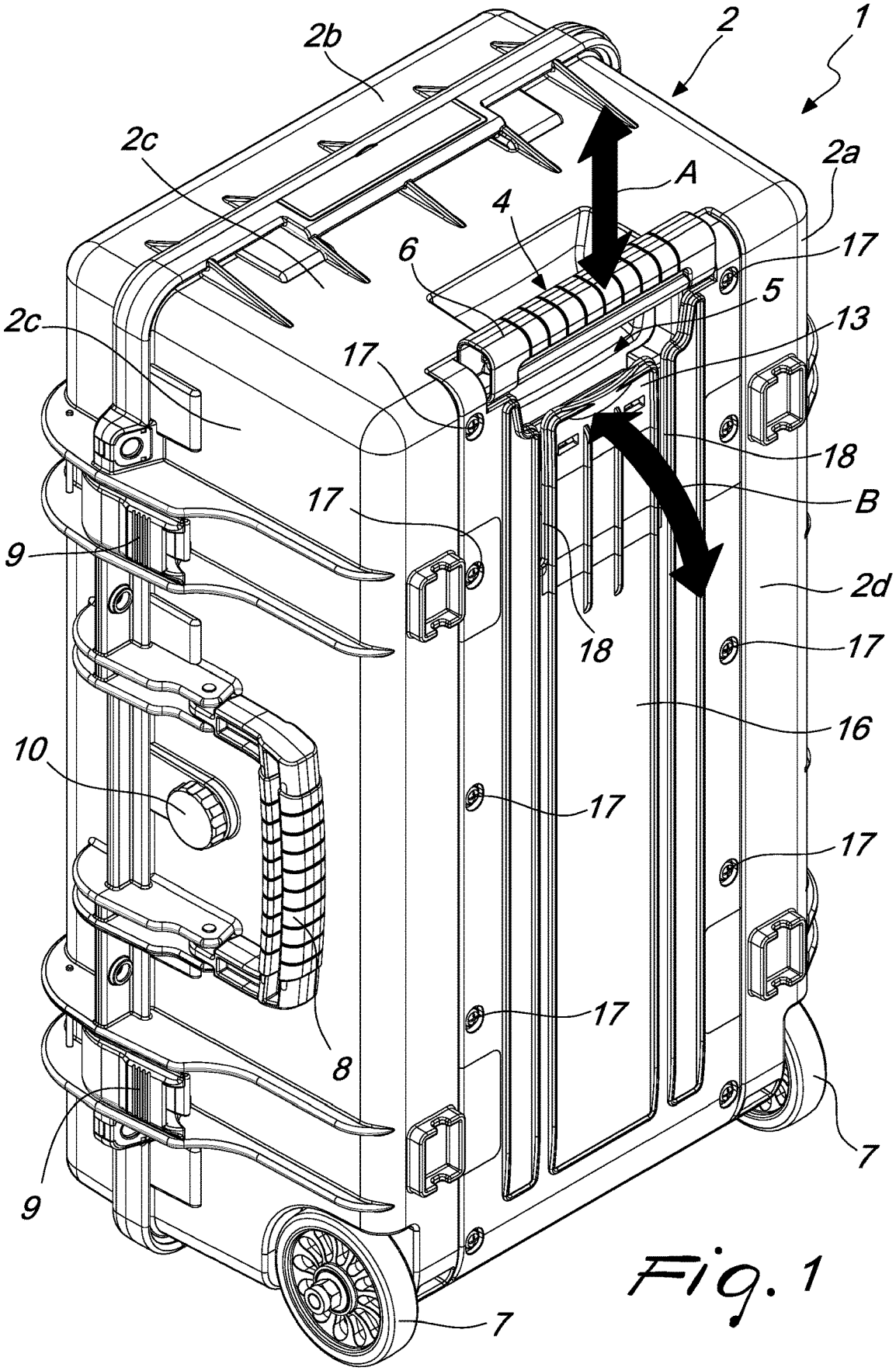
FIG. 1 is an axonometric view of the portable container according to the disclosure with the handle in the minimum protrusion configuration.
Figure 2:
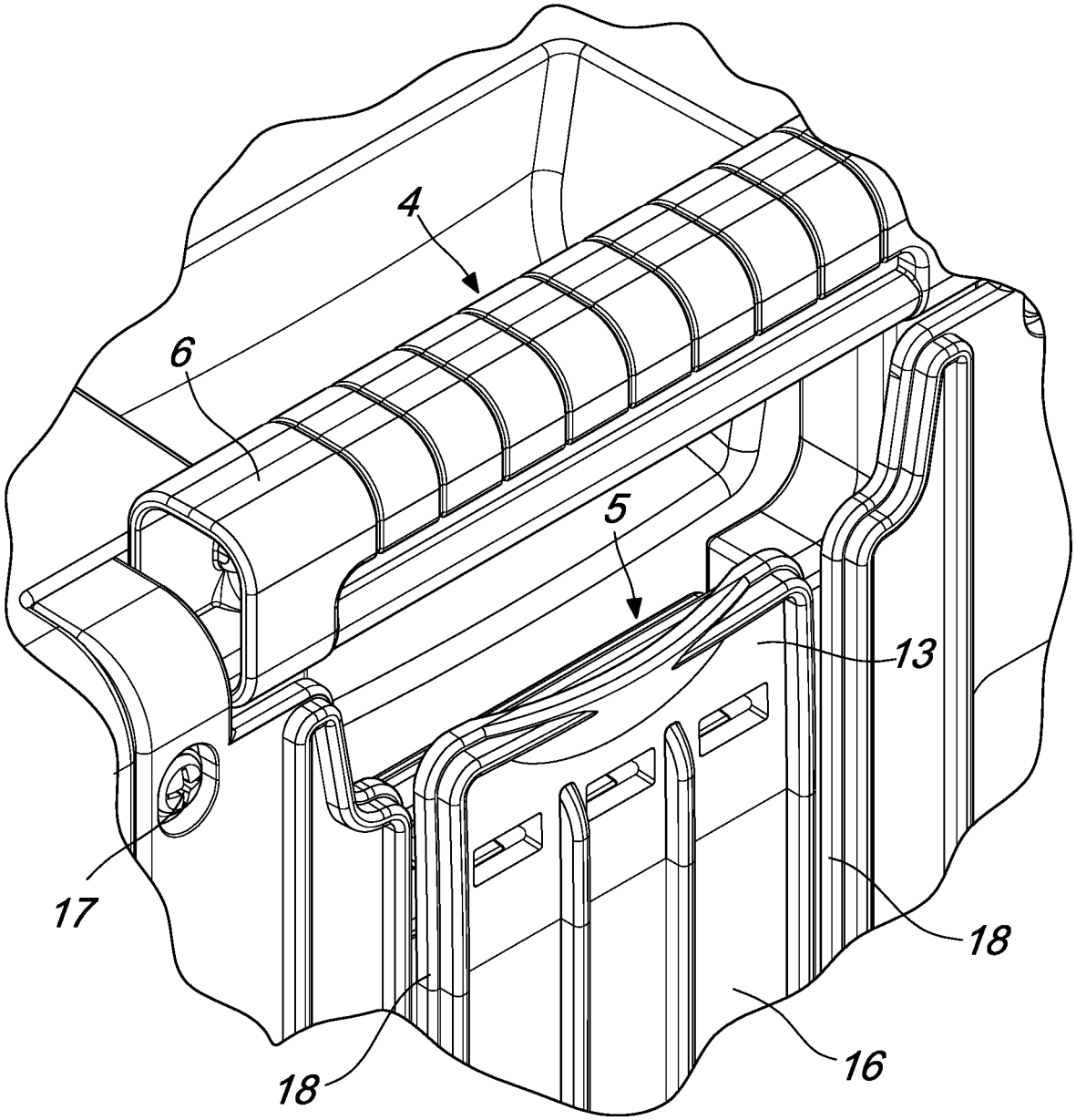
FIG. 2 is a highly enlarged-scale view of a detail of FIG. 1.
Figure 3:
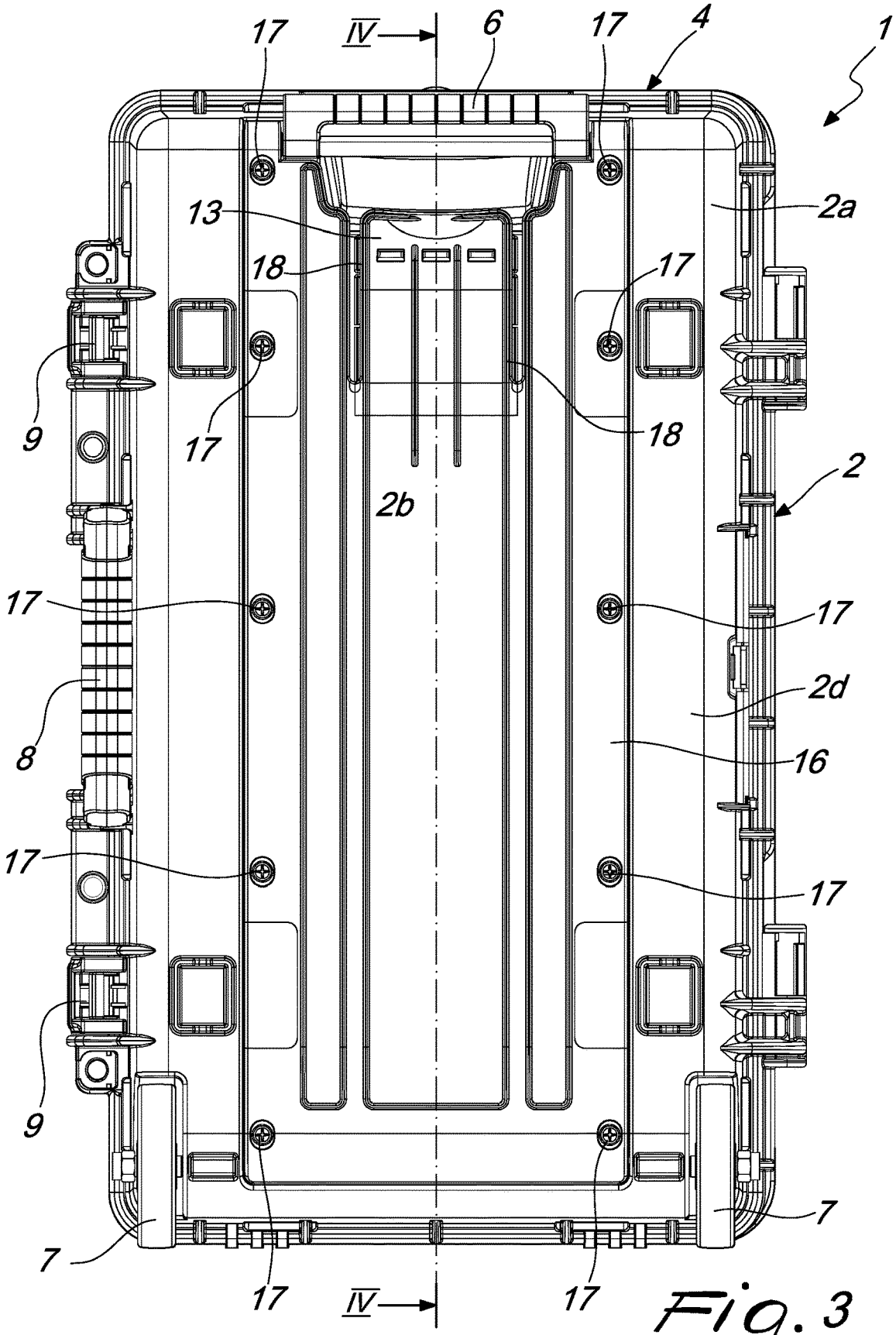
FIG. 3 is a view from below of the container of FIG. 1.
Figure 4:
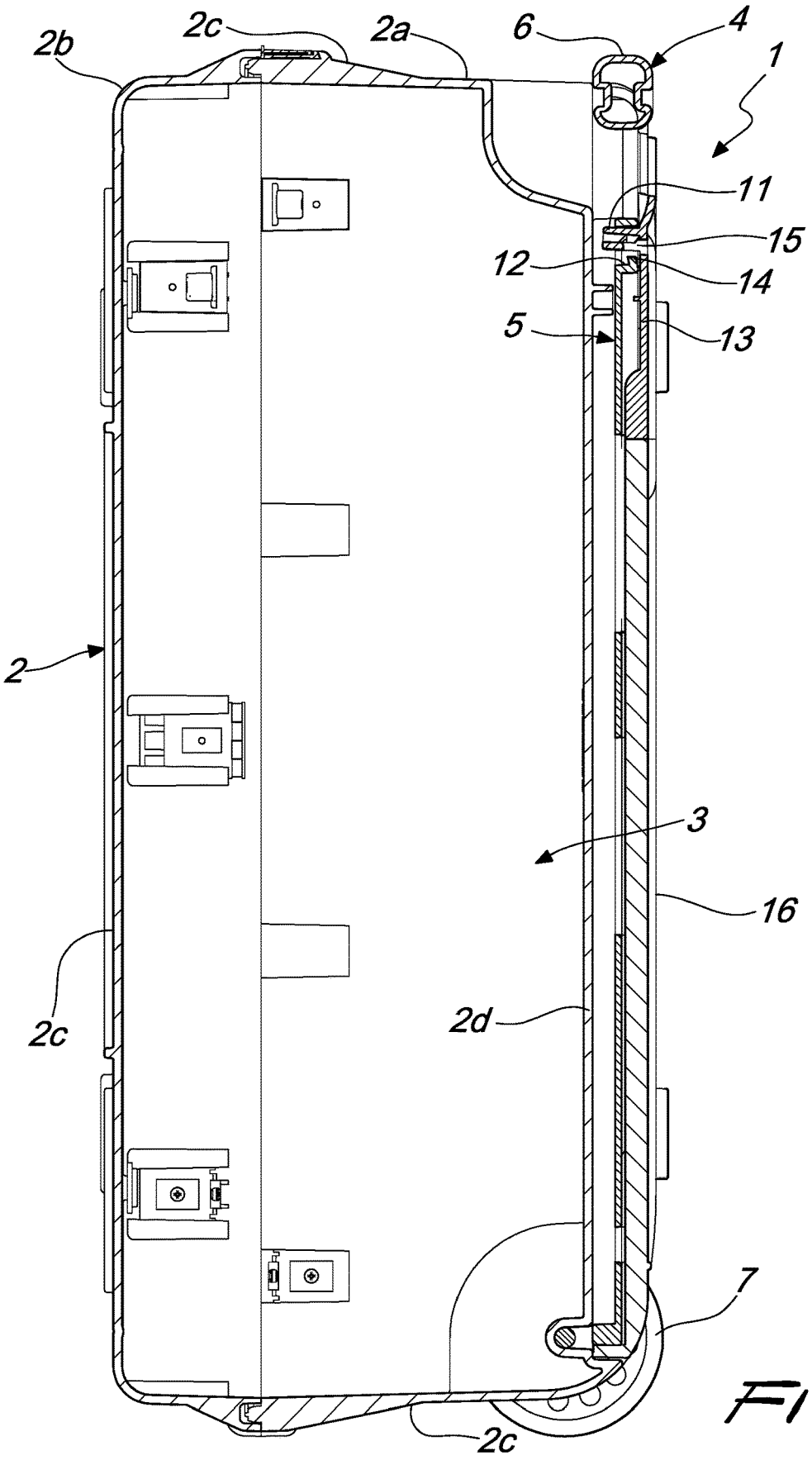
FIG. 4 is a sectional view of FIG. 3, taken along the plane IV-IV.
Figure 5:
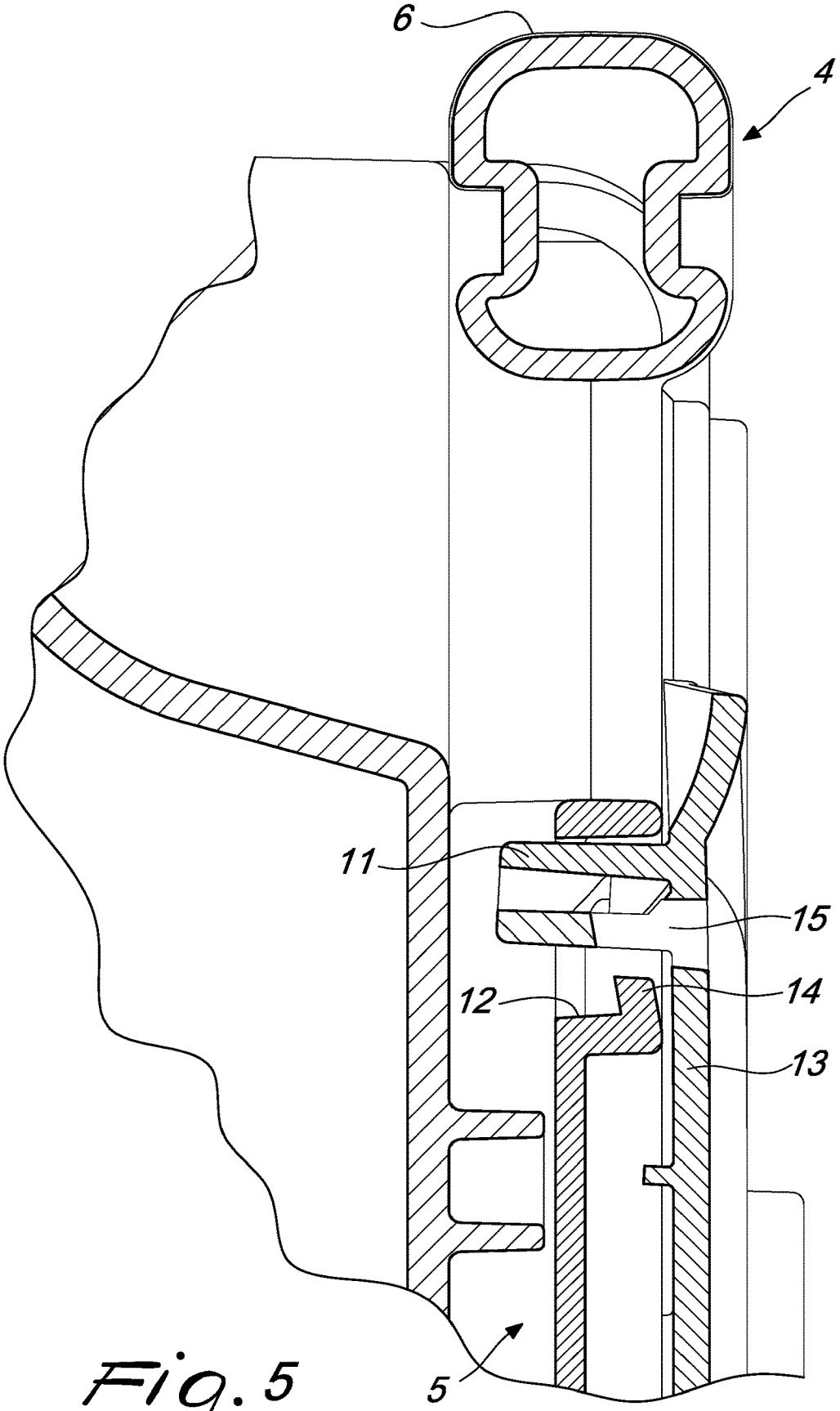
FIG. 5 is a highly enlarged-scale view of a detail of FIG. 4.

With particular reference to FIGS. 1-9, the reference numeral 1 generally designates a portable container, of the type of a trolley, suitcase, trunk, crate, and the like.

The container 1 comprises at least one outer shell 2 for delimiting at least one compartment 3 for accommodating objects in general (personal items, clothes, tools, equipment, electronic devices, etc.).

It is appropriate to specify that any reference made in the present description to containers 1 is to be understood as extending to any type of product (suitcase, trunk, crate, trolley, rucksack, pouch, bag, etcetera), capable of being accommodated in the compartment 3 and of carrying objects and tools of various kinds, both for private use and for professional purposes. Without abandoning the protective scope claimed herein, it is in fact possible to accommodate in a container 1 clothes, objects of various kinds and personal items, in private use, as well as tools, instruments, equipment, electronic gear or others, in professional use.

In the preferred application, in any case, the container 1 comprises a rigid shell 2 (composed typically but not exclusively of two mutually articulated shell portions 2*a*, 2*b* that may have the same dimensions or not), made of polymeric material with high impact resistance and provided with appropriate solutions that ensure the complete hermetic seal of the compartment 3 and therefore the capacity to prevent the entry of water, humidity, dust and contaminants in general. In any case, it is noted once again that the protective scope claimed herein is referred also to other types of container 1, which are more or less rigid and made of any material.

Furthermore, the container 1 comprises an extractable handle 4 (typically but not exclusively of the telescopic type), which can move (can translate or slide) between a minimum protrusion configuration and a maximum protrusion configuration (where usually a stroke limiter contrasts the further movement of said handle 4, preventing it from being able to disengage completely from the shell 2 and possibly be lost).

In the minimum protrusion configuration (in which the container 1 is shown for example in FIGS. 1-5), the handle 4 is arranged in a respective seat 5 (usually at least partially formed by the shell 2). In practice, typically in this situation the handle 4 remains substantially within the volume of the shell 2 and does not constitute a hindrance if the container 1 must be stored in a hold or in a baggage compartment, or even if a user wishes to grip the shell 2 and lift it. It should be noted in this regard that in this minimum protrusion configuration preferably one grip end 6 of the handle 4 is kept accessible from the outside, thus offering the user a practical way of carrying said container 1 (raised from the ground).

Vice versa, in the maximum protrusion configuration (FIGS. 6-7, for example), the handle 4 is extracted from the seat 5 (partially or completely and in any case, as already shown, typically up to a stroke limiter which prevents complete extraction).

Up to this point, the container 1 is of the known type and in the maximum protrusion configuration the handle 4 can be gripped by a user (again preferably at the grip end 6) for a different and equally practical mode of transport, in which said container 1 is dragged while resting on the ground also by virtue of a pair of wheels 7 mounted on the outside of the shell 2.

Furthermore, the container 1 can be provided with different components and accessories, such as handles 8, locks 9, safety valves 10, or others, falling in any case within the protective scope claimed herein.

Figure 8:
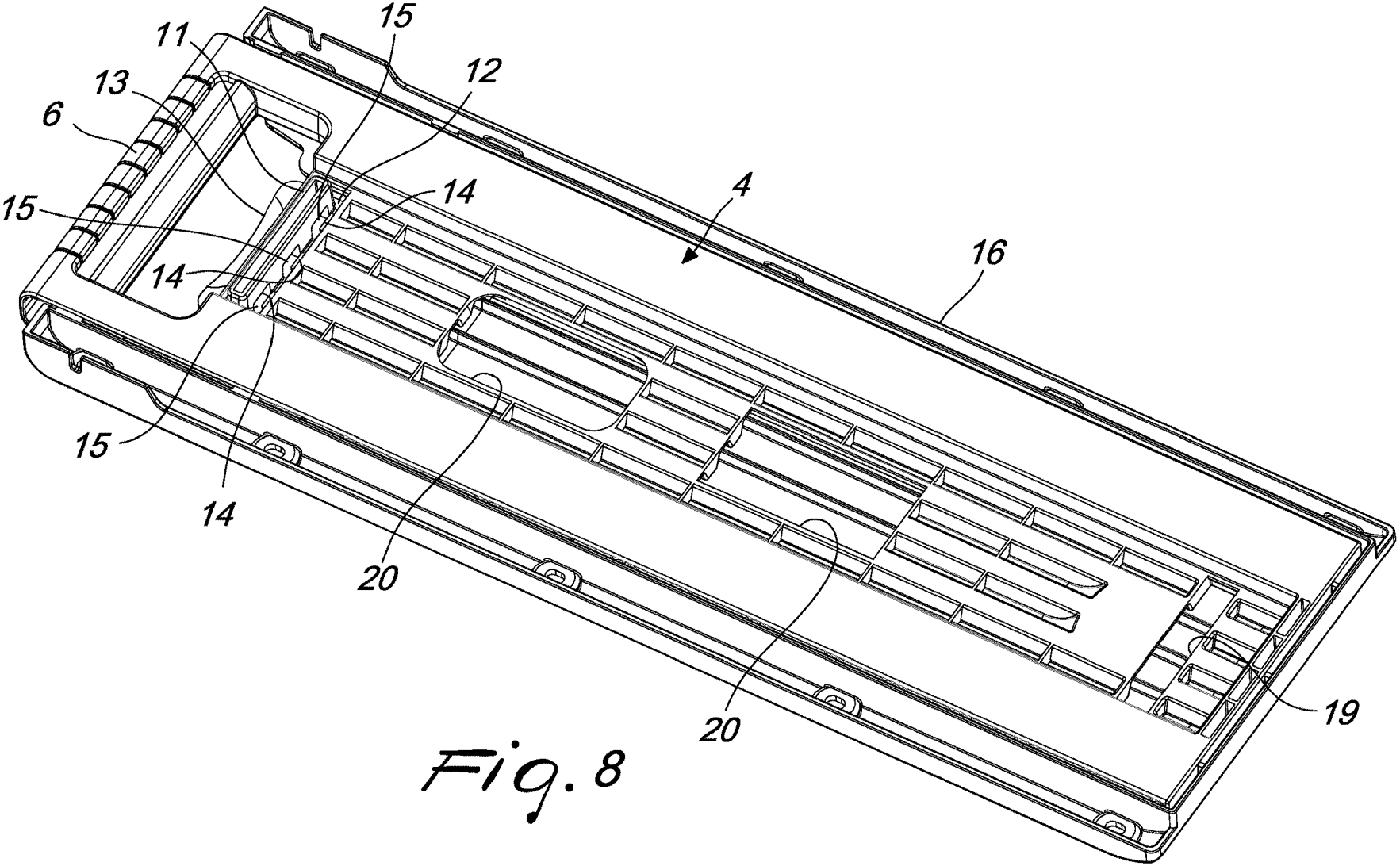
FIG. 8 is a perspective view of the handle and of another component of the container according to the disclosure.
Figure 9:
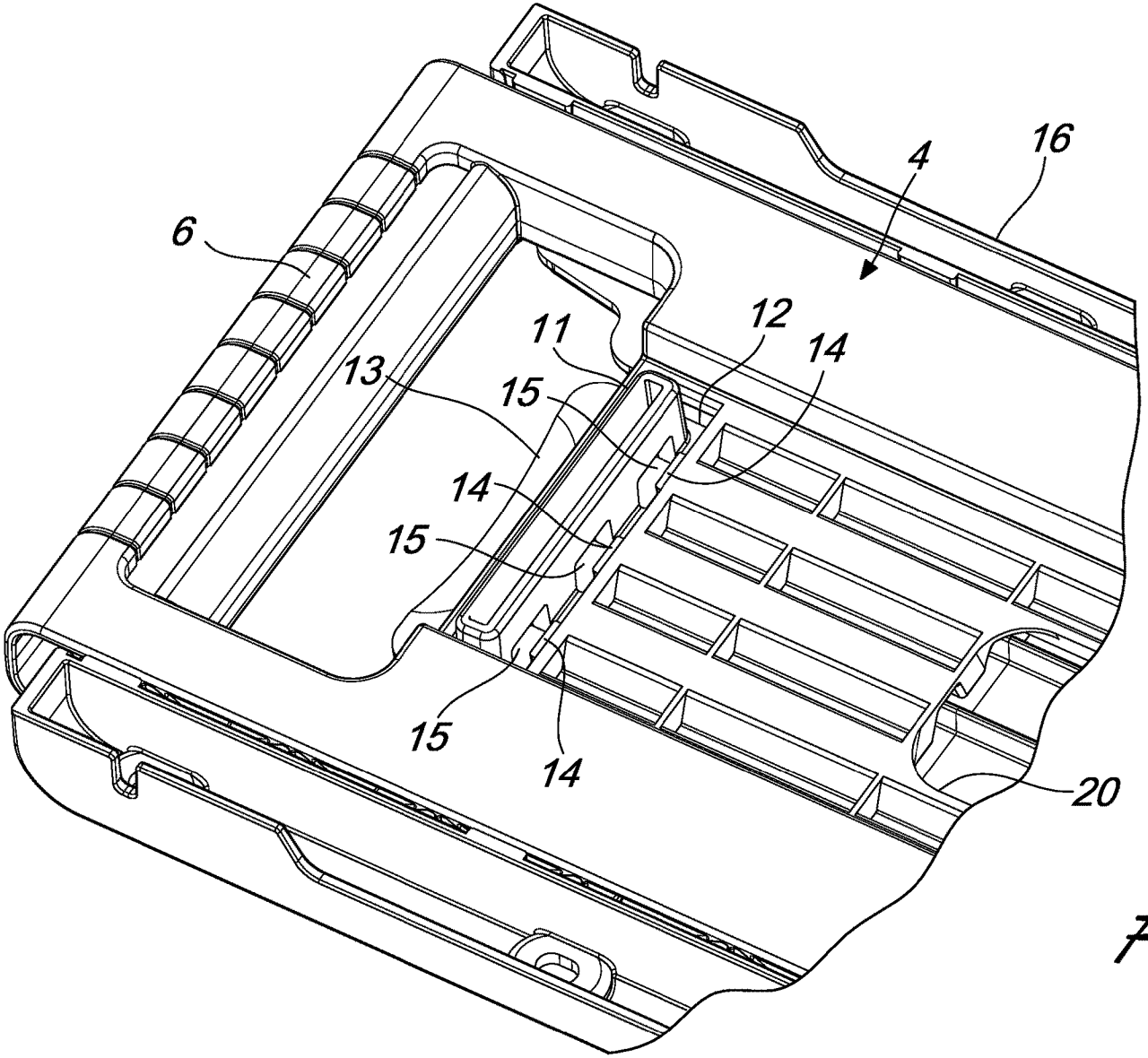
FIG. 9 is a highly enlarged-scale view of a detail of FIG. 8.

Also in known ways, in the container 1 according to the disclosure the free movement from the minimum protrusion configuration is contrasted by at least one tooth 11, which is normally inserted with play in a slot 12 (FIG. 7) provided along the handle 4 (the tooth 11 and the slot 12 in which it is inserted are clearly visible for example in FIGS. 8 and 9).

In practice, if the user simply tries to extract the handle 4 from the seat 5, the stroke that is allowed to said handle is at most equal only to the play between the tooth 11 and the slot 12, after which the tooth 11 rests against the edge of the slot 12 and any further movement is prevented.

When the tooth 11 rests on the slot 12, the handle 4 is therefore locked and the user can lift the container 1 from the ground, gripping it at the end 6.

The tooth 11 is supported by a respective tongue 13, which is fixed to the shell 2 and is elastically deformable. The elastic deformation of the tongue 13 can be produced by a user and in any case causes the extraction of the tooth 11 from the slot 12 and the consequent clearance to the free movement of the handle 4 (which can thus be moved by the user to the maximum protrusion configuration). It is specified that in the present description the expression "elastically deformable" tongue 13 is understood to mean that (due to the materials and the shape chosen and to the constraints to the other components) the tongue 13 is indeed given the possibility of elastic deformation under the action of a user (and therefore as a function of the force that said user can generate).

According to the disclosure, the container 1 comprises at least one protrusion 14 which protrudes from the edge of the slot 12 and at least one respective recess 15 provided on the tooth 11.

In the minimum protrusion configuration, the recess 15 faces and is aligned with the protrusion 14 along the direction of movement A of the handle 4, so as to produce the automatic insertion of the protrusion 14 in the recess 15 following a movement of the handle 4 from the minimum protrusion configuration and obtain the subsequent hindrance to the elastic deformation of the tongue 13.

In other words, as long as the handle 4 is kept in the minimum protrusion configuration, the protrusion 14 is spaced from the recess 15 (by virtue of the fact that the tooth 11 is inserted with play in the slot 12) and, as shown, it is possible to deform (preferably bend) the tongue 13 in order to disengage the tooth 11 from the slot 12 and move the handle 4 freely.

When instead the handle 4 is gripped without previously acting on the tongue 13 (for example to lift the container 1), the tooth 11 rests against the edge of the slot 12 and automatically the protrusion 14 enters the recess 15.

This prevents any subsequent deformation of the tongue 13 (since indeed the protrusion 14 is retained in the recess 15) which might otherwise occur accidentally, under the weight of the container 1, and this ensures the achievement of the intended aim.

Figure 6:
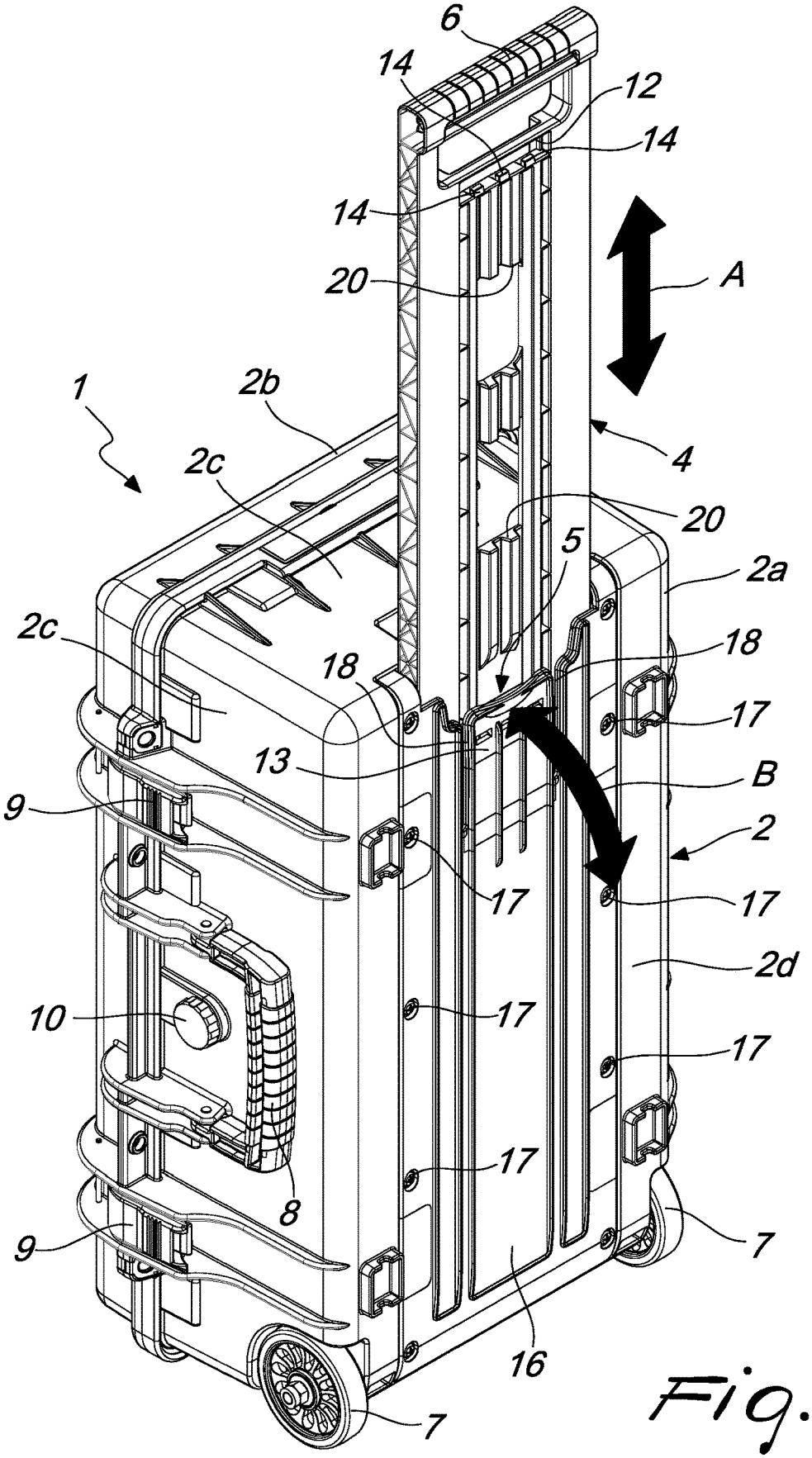
FIG. 6 is a perspective view of the portable container according to the disclosure with the handle in the maximum protrusion configuration.
Figure 7:
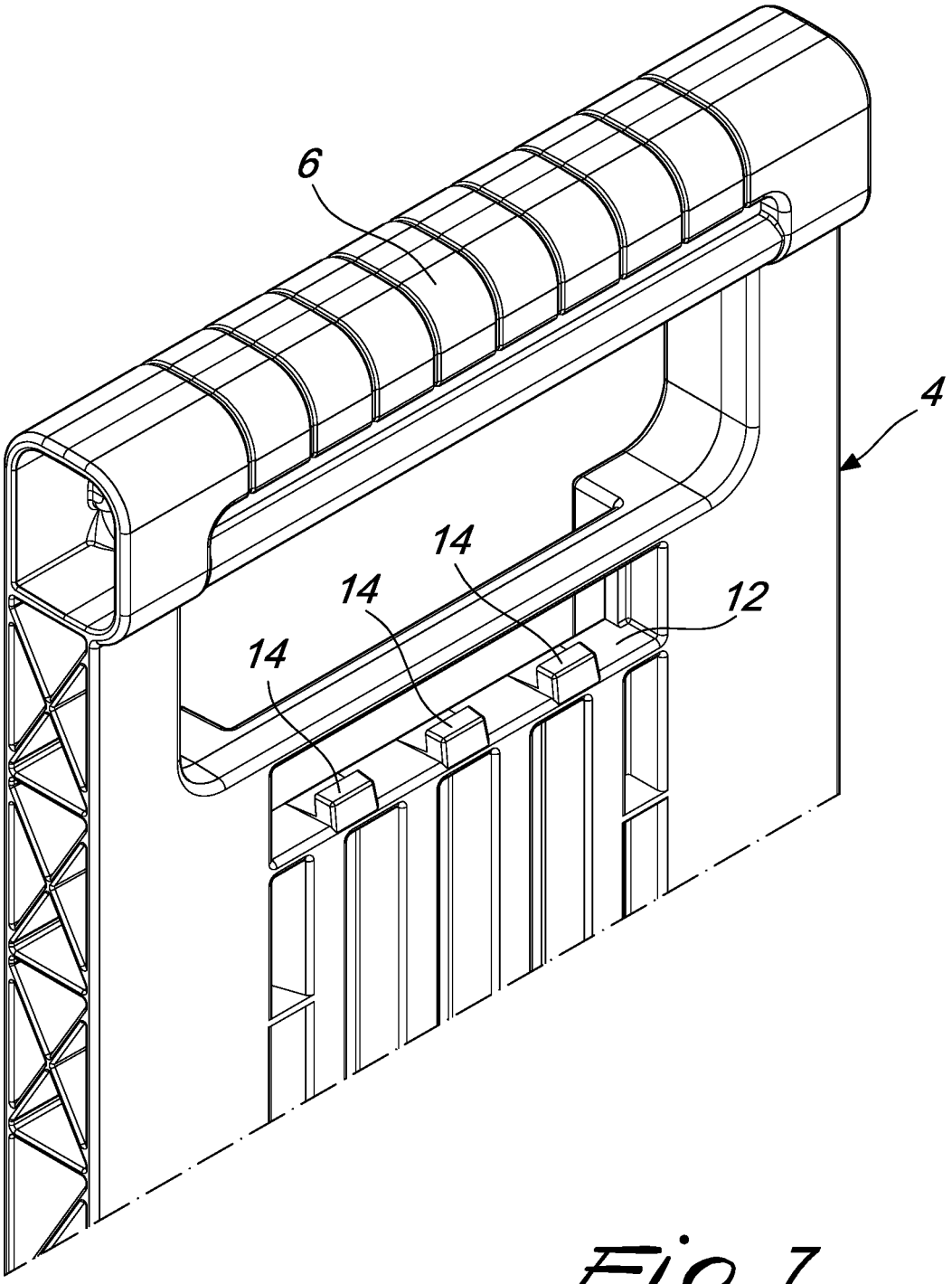
FIG. 7 is a highly enlarged-scale view of a detail of FIG. 6.

The direction of movement A (translation or sliding) is shown for the sake of simplicity only in FIGS. 1 and 6. Likewise, in these FIGS. 1 and 6 an arrow B indicates the direction of the elastic deformation allowed to the tongue 13 (in the preferred but not exclusive embodiment), which typically includes a bending/flexing around an axis that is perpendicular to the direction of movement A.

In particular, in order to obtain a more effective contrast to the accidental deformation of the tongue 13, the container 1 comprises a plurality of protrusions 14, which are arranged mutually side-by-side and protrude from said edge of the slot 12, and a plurality of respective recesses 15 provided on the side of the tooth 11, which, in the minimum protrusion configuration, face and are aligned with corresponding protrusions 14 along the direction of movement A of the handle 4.

The constructive solution of the accompanying figures provides, for this purpose, three protrusions 14 (and three corresponding recesses 15), but the protective scope claimed herein extends to containers 1 provided with any number of protrusions 14 (and corresponding recesses 15). In the following description, in any case, any reference to a protrusion 14 and/or to a recess 15 is to be understood as referring also to all the protrusions 14 and recesses 15 with which each container 1 can be provided.

In a preferred but in any case nonlimiting constructive solution, the protrusion 14 and the recess 15 have substantially the shape of a parallelepiped (obviously with dimensions chosen so as to allow practical insertion of the protrusion 14 in the recess 15).

With further reference to the preferred constructive solution, shown also in the accompanying figures by way of nonlimiting example of the application of the disclosure, the tooth 11 is constituted substantially by a ridge that is elongated along an axis that is transverse to the direction of movement A of the handle 4 (said ridge is clearly visible for example in FIGS. 8-9). The recess 15 is thus provided on a side of the ridge (again as can be seen in particular in FIGS. 8-9). In turn, in this constructive solution the slot 12 has a shape that corresponds to the elongated shape of the ridge.

It should be noted that the seat 5 can be defined in various manners, with the handle 4 which (in the minimum protrusion configuration) can be more or less hidden from the view of the user indeed as a function of the specific constructive choices adopted in each instance (which are in any case within the protective scope claimed herein).

For example, in fact, the handle 4 can be accommodated slidingly in a seat 5 constituted by a sort of groove that is open outward and is provided on one face of the shell 2 (thus remaining almost entirely visible even in the minimum protrusion configuration).

In the embodiment of the accompanying figures, proposed by way of nonlimiting example of the application of the disclosure, the seat 5 is constituted substantially by an interspace that is interposed between a wall 2*c*, 2*d* of the shell 2, which is preferably chosen so as to correspond to the bottom wall 2*d* (but it might indeed be one of the others), and an outer housing 16, which is integral with the shell 2. In order to obtain the substantial flatness of the bottom of the shell 2, even more preferably the bottom wall 2*d* has a central hollow in which indeed the interspace is indeed formed, and is closed by the housing 16, which in turn is fixed for example by means of screws 17 to the shell 2.

More particularly, the housing 16 comprises a plate (which is indeed fixed by means of screws 17 to the shell 2) which has, at a peripheral portion thereof a pair of parallel slits 18, which delimit the tongue 13 (and extend to one of the short sides of the plate). In the preferred embodiment, in other words, the tongue 13 is constituted by a flap of the plate which in practice constitutes the housing 16 and is rendered elastically deformable (differently from the rest of the housing 16) by the presence of the slits 18.

Usefully, the handle 4 is provided with a window 19 (FIG. 8) which is aligned with the tooth 11 along the direction of movement A. By choosing appropriately the position of the window 19 (which preferably has a shape and dimensions which are similar to those of the slot 12), when the handle 4 reaches the maximum protrusion configuration, the tooth 11 automatically enters the window 19, in order to contrast the subsequent free movement of the handle 4 from the maximum protrusion configuration. The window 19 can also act as a stroke limiter.

In other words, by defining a center distance between the window 19 and the slot 12 that is equal to the maximum stroke of the handle 4 between the minimum and maximum protrusion configurations, when the handle 4 reaches the latter the tooth 11 (supported by the tongue 13, kept until then elastically deformed to allow extraction) faces the window 19. Thus the user can release the tongue 13 to obtain the elastic return to the non-deformed condition, in which indeed the tooth 11 enters the window 19 to obtain a new locking of the handle 4.

The operation of the portable container according to the disclosure has already been described above.

The portable container 1 is provided with a shell 2 which forms (at least) one compartment 3 in which, according to per se traditional methods, it is possible to store objects of various kinds (for private and/or professional use).

The extractable handle 4 can be gripped by a user (preferably at the grip end 6) in at least two different extreme minimum and maximum protrusion configurations.

In the minimum protrusion configuration, the tooth 11 supported by the tongue 13 is inserted in the slot 12 of said handle 4 and contrasts the free movement of the latter. If the user grips the grip end 6 and lifts the handle 4 without previously acting on the tongue 13, after a very short stroke (equal approximately to the play between the tooth 11 and the slot 12), the relative movement of the handle 4 with respect to the shell 2 in fact stops due to the mechanical obstacle constituted indeed by the resting of the tooth 11 against the edge of the slot 12. This indeed allows to lift the container 1 by gripping it by the handle 4.

In this condition, at the end of the short stroke allowed to the handle 4, the protrusions 14 that protrude from the edge of the slot 12 automatically enter the recesses 15 of the tooth 11 to prevent any deformation of the tongue 13, which otherwise might accidentally occur due to the stresses caused by the weight of the container 1 and of the objects inside it. Therefore, resorting to protrusions 14 and recesses 15 fully achieves the intended aim, since it allows the portable container 1 to contrast effectively the accidental extraction of the handle 4.

It should be noted furthermore that contrast occurs due to the mechanical obstacle produced by the insertion of the protrusions 14 in the recesses 15: this obstacle remains independently of any force applied to the tongue 13 and to the shell 2 by the objects in the compartment 3 (and in general deriving from the overall weight of the container 1). Therefore, the portable container 1 is capable of reducing or avoiding the danger of accidental extraction of the handle 4 even when said container 1 is loaded heavily.

When instead the user wishes to actually move the handle 4 from the minimum protrusion configuration to the maximum protrusion configuration, he must first deform elastically the tongue 13 (the deformation typically includes a bending/flexing about an axis that is transverse to the direction of movement of the handle 4). Thus, the tooth 11 disengages from the slot 12 and no longer constitutes a hindrance to the free movement of the handle 4 (during which the tongue 13 is in any case kept elastically deformed).

It is noted that in the minimum protrusion configuration the protrusions 14 and the recesses 15 face each other and are arranged at a distance that is sufficient to allow indeed the disengagement of the tooth 11 (by virtue of the insertion of the latter with play within the slot 12).

It should be noted that the practical methods that allow the disclosure to avoid accidental extraction do not depend in any way on the rigidity or on other properties of the tongue 13, which therefore can be designed in such a manner as to ensure easy voluntary extraction (the rigidity of the tongue 13 is chosen so as to not impose an excessive effort on the user who wishes to cause its elastic deformation).

As a consequence of reaching the maximum protrusion configuration, with the handle 4 extracted from the seat 5, the shell 2 can thus be (preferably but not exclusively) rested on the wheels 7 during the transport of the container 1. Furthermore, in this situation the tooth 11 can restore a sort of a lock of the movement of the handle 4 due to its insertion in the window 19.

Finally, it should be noted that it is possible to provide along the handle 4 lightening grooves 20, but preferably they will not be provided proximate to the window 19, in order to reduce the risk that a user might inadvertently insert a finger therein during the movement of the handle 4, thus ensuring safe use of the disclosure.

The disclosure thus conceived is susceptible of numerous modifications and variations, all of which are within the scope of the inventive concept; all the details may furthermore be replaced with other technically equivalent elements.

In the examples of embodiment shown, individual characteristics, given in relation to specific examples, may actually be interchanged with other different characteristics that exist in other examples of embodiment.

In practice, the materials used, as well as the dimensions, may be any according to the requirements and the state of the art.

What is claimed is:

1. A portable container comprising:

at least one outer shell, for delimiting at least one accommodation compartment for objects in general, and an extractable handle configured to move between a minimum protrusion configuration, in which said handle is arranged in a respective seat, and at least one maximum protrusion configuration, in which said handle is extracted from said seat, free movement from said minimum protrusion configuration is prevented by at least one tooth configured to be inserted with play in a slot provided along said handle and is supported by a respective tongue fixed to said shell and is elastically deformable configured for the extraction of said tooth from said slot following said elastic deformation and consequent clearance for the free movement of said handle, further comprising at least one protrusion that protrudes from the edge of said slot and at least one respective recess provided on said tooth, which faces and is aligned with said protrusion along the direction of movement of said handle in said minimum protrusion configuration, for the automatic insertion of said at least one protrusion in said at least one recess following a movement of said handle from said minimum protrusion configuration and the subsequent hindrance to the elastic deformation of said tongue.

2. The portable container according to claim 1, further comprising a plurality of said protrusions arranged mutually side by side and protrude from said edge, and a plurality of respective said recesses provided on said side of said tooth, which face and are aligned with corresponding said protrusions along said direction of movement of said handle in said minimum protrusion configuration.

3. The portable container according to claim 1, wherein said at least one protrusion and the said at least one recess having a substantially parallelepiped shape.

4. The portable container according to claim 1, wherein said tooth is constituted Currently Amended by a ridge elongated along an axis that is transverse to said direction of movement of said handle, said at least one recess being provided on one side of said ridge.

5. The portable container according to claim 1, wherein said seat is constituted substantially by an interspace interposed between a wall of said outer shell corresponding to a bottom wall, and an outer housing integral with said shell.

6. The portable container according to claim 5, wherein said housing comprises a plate having a pair of parallel slits at a peripheral portion, said pair of parallel slits delimit said tongue.

7. The portable container according to claim 1, wherein said handle is provided with a window aligned with said tooth along said movement direction, said tooth being inserted automatically in said window, when said handle reaches said maximum protrusion configuration, in order to prevent the subsequent free movement of said handle from said maximum protrusion configuration.

* * * * *